US008776704B2

(12) United States Patent
Imaizumi et al.

(10) Patent No.: US 8,776,704 B2
(45) Date of Patent: Jul. 15, 2014

(54) SEWING MACHINE

(71) Applicants: Kazutaka Imaizumi, Nagoya (JP); Masashi Tokura, Konan (JP)

(72) Inventors: Kazutaka Imaizumi, Nagoya (JP); Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/935,009

(22) Filed: Jul. 3, 2013

(65) Prior Publication Data

US 2014/0026794 A1 Jan. 30, 2014

(30) Foreign Application Priority Data

Jul. 30, 2012 (JP) ..... 2012-167859

(51) Int. Cl.
*D05B 39/00* (2006.01)
*D05C 9/16* (2006.01)

(52) U.S. Cl.
USPC ..... 112/470.17

(58) Field of Classification Search
USPC ..... 112/65, 220, 470.01–470.11, 112/470.13–470.18; 700/136–138
See application file for complete search history.

(56) References Cited

U.S. PATENT DOCUMENTS

| | | | | |
|---|---|---|---|---|
| 4,019,447 | A * | 4/1977 | Blessing et al. | 112/470.01 |
| 4,458,612 | A * | 7/1984 | Asai et al. | 112/447 |
| 5,379,226 | A * | 1/1995 | Shigeta | 700/137 |
| 7,527,005 | B2 * | 5/2009 | Matsumoto et al. | 112/470.17 |
| 2003/0188675 | A1 * | 10/2003 | Valeriote et al. | 112/117 |
| 2010/0192824 | A1 | 8/2010 | Matsumoto et al. | |
| 2012/0048163 | A1 * | 3/2012 | Tokura | 112/447 |
| 2014/0026794 | A1 * | 1/2014 | Imaizumi et al. | 112/470.01 |

FOREIGN PATENT DOCUMENTS

| | | |
|---|---|---|
| JP | A-04-089087 | 3/1992 |
| JP | A-04-364884 | 12/1992 |
| JP | A-2010-178837 | 8/2010 |

* cited by examiner

*Primary Examiner* — Ismael Izaguirre
(74) *Attorney, Agent, or Firm* — Oliff PLC

(57) ABSTRACT

A sewing machine to which a circular stitching device configured to anchor a sewing workpiece in a rotatable manner includes a feeding device, a sewing device, a processor, and a memory. The memory is configured to store computer-readable instructions that, when executed by the processor, cause the sewing machine to execute the steps of specifying a distance between an anchor position and a needle drop point, changing first feed amount data into second feed amount data based on the specified distance and a length of a stitch pattern, specifying an actual amount of movement of the sewing workpiece, and revising the second feed amount data for at least one stitch, among stitches of a plurality of iterations of the stitch pattern, that is not yet formed, based on a difference between the specified actual amount of movement and a planned feed amount indicated by the second feed amount data.

9 Claims, 11 Drawing Sheets

SEWING MACHINE

CROSS-REFERENCE TO RELATED APPLICATION

This application claims priority to Japanese Patent Application No. 2012-167859, filed Jul. 30, 2012, the content of which is hereby incorporated herein by reference in its entirety.

BACKGROUND

The present disclosure relates to a sewing machine that is capable of sewing a circular shape by sewing a plurality of iterations of a single stitch pattern using a circular stitching device.

A circular stitching device for repeatedly sewing a selected stitch pattern around the circumference of a circle is known. When the circular stitching device is used, a user may, for example, anchor a single point on a cloth to a needle plate of a zigzag sewing machine by inserting a pin from above the cloth into one of a plurality of holes that are provided in the needle plate. A CPU of the sewing machine recognizes the distance from the anchored point to the center of a needle, that is, the radius of the circle, and computes the circumference based on the radius. Based on the circumference and on the length of the selected stitch pattern, the CPU computes revision data and the number of times that the stitch pattern, with its length revised, will be sewn, then stores the results. Based on the revision data, the CPU revises the length of the stitch pattern for the computed number of times that it will be sewn, then sews the stitch pattern, with its length revised, such that the point where the sewing ends matches the point where the sewing started.

SUMMARY

In the actual sewing, puckering may occur in a sewing workpiece such as a work cloth or the like. The degree of the puckering may differ according to the type of the sewing workpiece. Accordingly, even in a case where the sewing has been performed based on the revision data that have been created by the method described above, the point where the sewing ends may not match the point where the sewing started, and misalignment between the stitch patterns may occur.

Various embodiments of the broad principles derived herein provide a sewing machine that is capable of sewing a circular shape by sewing a plurality of iterations of a single stitch pattern using a circular stitching device and that is able to inhibit misalignment between the first iteration of the stitch pattern and the final iteration of the stitch pattern, even if puckering occurs in the sewing workpiece during the actual sewing.

Various embodiments herein provide a sewing machine to which a circular stitching device is mountable. The circular stitching device is configured to anchor a sewing workpiece in a rotatable manner at an anchor position that is set apart from a needle drop point, which is a position where a sewing needle pierces the sewing workpiece. The sewing machine includes a feeding device, a sewing device, a processor, and a memory. The feeding device is configured to feed the sewing workpiece in a specified feed direction. The sewing device is configured to form a stitch in the sewing workpiece that is fed by the feeding device. The memory is configured to store computer-readable instructions that, when executed by the processor, cause the sewing machine to execute the steps of specifying a distance between the anchor position and the needle drop point, changing first feed amount data into second feed amount data based on the specified distance and a length in the feed direction of a stitch pattern that includes stitches, specifying an actual amount of movement of the sewing workpiece that is fed by the feeding device based on the second feed amount data, and revising the second feed amount data for at least one stitch, among the stitches of the plurality of iterations of the stitch pattern, that is not yet formed. The first feed amount data indicates a planned feed amount set in advance. The planned feed amount is a planned amount for the sewing workpiece to be fed by the feeding device in order for the stitches of the stitch pattern to be formed. The second feed amount data indicates the planned feed amount that makes a length of a circumference of a circle having a radius of the specified distance to be equal to a length in the feed direction of a plurality of iterations of the stitch pattern. The second feed amount is revised based on a difference between the specified actual amount of movement and the planned feed amount that is indicated by the second feed amount data.

BRIEF DESCRIPTION OF THE DRAWINGS

Embodiments will be described below in detail with reference to the accompanying drawings in which.

DETAILED DESCRIPTION

Figure 1:
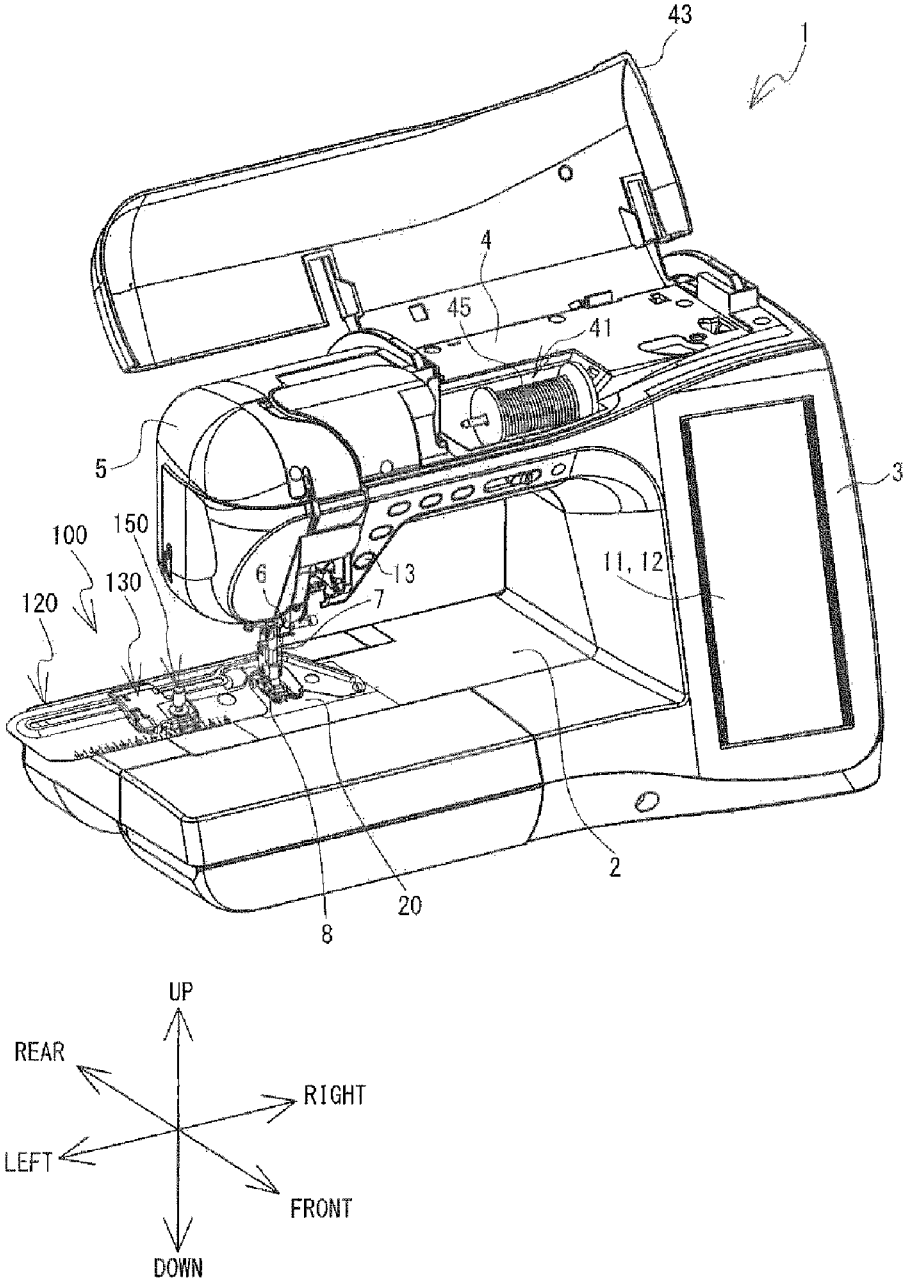
FIG. 1 is an oblique view of a sewing machine in a state in which a circular stitching device is mounted on it.

Hereinafter, an embodiment will be explained with reference to the drawings. First, a physical configuration of a sewing machine 1 will be explained with reference to FIGS. 1 to 3. The top side, the bottom side, the right front side, the left rear side, the left front side, and the right rear side in FIG. 1 respectively define the top side, the bottom side, the front side, the rear side, the left side, and the right side of the sewing machine 1. In other words, the side on which a start/stop switch 13 is disposed is the front side of the sewing machine 1. The longitudinal direction of a bed 2 and an arm 4 is the left-right direction of the sewing machine 1. The side on which a pillar 3 is disposed is the right side. The direction in which the pillar 3 extends is the up-down direction of the sewing machine 1.

As shown in FIG. 1, the sewing machine 1 includes the bed 2, the pillar 3, the arm 4 and a head 5. The bed 2 is a base portion of the sewing machine 1 and extends in the left-right direction. The pillar 3 extends upward from the right end of the bed 2. The arm 4 extends to the left from the upper end of the pillar 3 such that the arm 4 faces the bed 2. The head 5 is a portion that connects to the left end of the arm 4.

Figure 2:
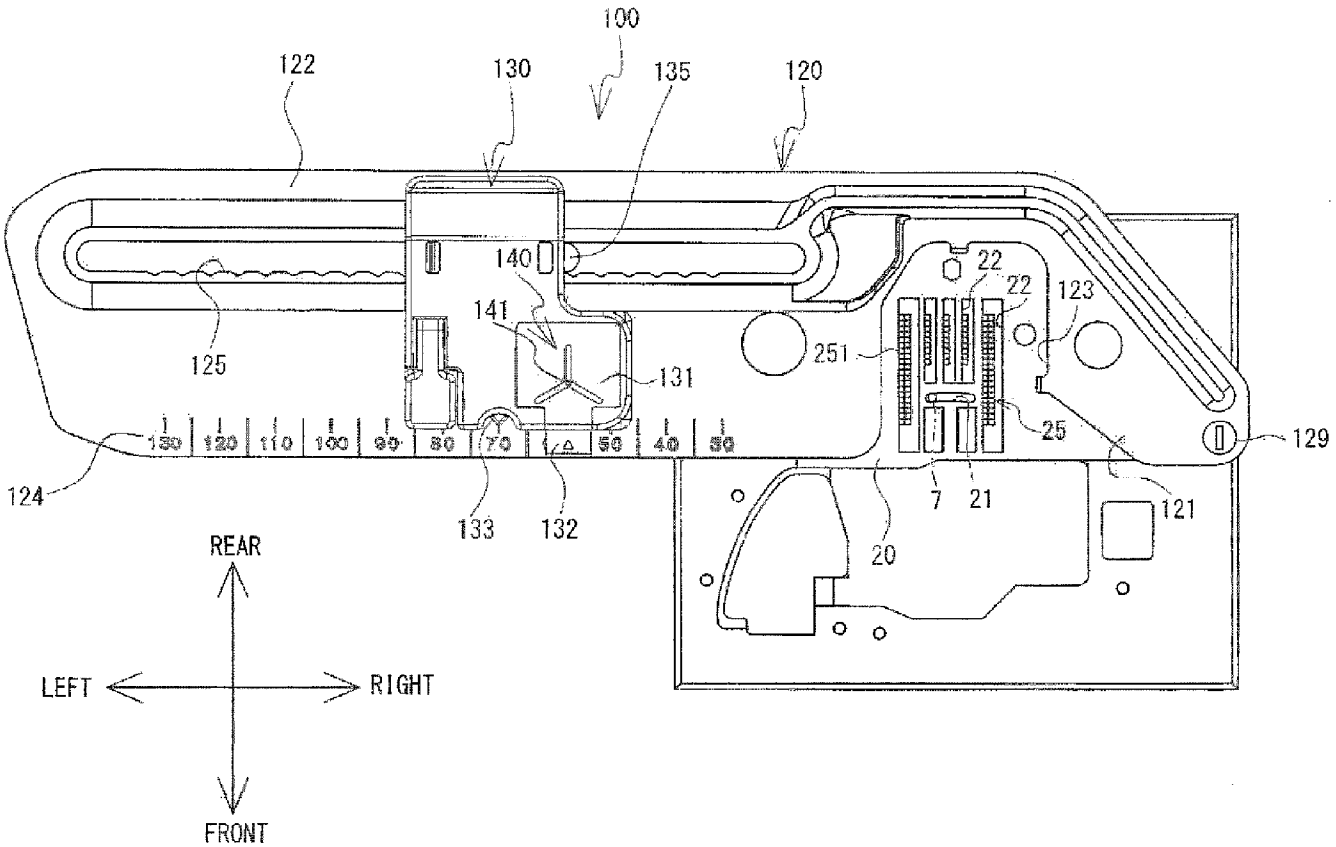
FIG. 2 is a plan view of the circular stitching device in a state in which a pivot pin has been removed.

A needle plate 20 is disposed in a top face of the bed 2. As shown in FIG. 2, the needle plate 20 has a needle hole 21 and a plurality of rectangular holes 22 that are provided around the needle hole 32. The needle hole 21, into which a sewing needle 7 can be inserted, is a long hole that is longer in the left-right direction and that is slightly curved. The plurality of rectangular holes 22 are configured such that teeth 251 that are formed on a feed dog 25 can be moved up and down through the rectangular holes 22.

The feed dog 25, a feed mechanism 87 (refer to FIG. 5), a shuttle mechanism (not shown in the drawings) and the like are provided in the bed 2 below the needle plate 20. The feed dog 25 are configured to be driven by the feed mechanism 87 and to feed a sewing workpiece in a predetermined feed direction (toward the front or toward the rear of the sewing machine 1). The feed mechanism 87 is a mechanism that is configured to move the feed dog 25 in the up-down direction and the front-rear direction. A bobbin on which a lower thread is wound may be housed in the shuttle mechanism. The shuttle mechanism is a mechanism that is configured to form a stitch in the sewing workpiece in conjunction with the sewing needle 7 that is attached to the lower end of a needle bar 6 that will be described later.

As shown in FIG. 1, a liquid crystal display (hereinafter called the LCD) 11, which has a vertically long rectangular shape, is provided on the front face of the pillar 3. Images that include various types of items, such as commands, illustrations, setting values, messages, and the like, may be displayed on the LCD 11. A touch panel 12 that is configured to detect a position where the touch panel 12 is pressed is provided on the front face side of the LCD 11. When a user performs an operation of pressing on the touch panel 12 by using a finger or a special stylus pen, the touch panel 12 detects the pressed position. An item that is selected in the image can be recognized based on the detected pressed position. Hereinafter, an operation of pressing on the touch panel 12 will be called a panel operation. By performing a panel operation, the user can select a pattern to be sewn or a command to be executed.

A cover 43 to be opened and closed is provided on an upper portion of the arm 4. FIG. 1 shows a state in which the cover 43 is opened. A thread housing portion 41 is provided underneath the cover 43, that is, within the arm 4. A thread spool that may supply an upper thread may be housed in the thread housing portion 41. A drive shaft (not shown in the drawings) extends in the left-right direction within the arm 4. The drive shaft may be driven to rotate by a sewing machine motor 81 (refer to FIG. 5). Various switches that include the start/stop switch 13 are provided in the lower portion of the front face of the arm 4. The start-and-stop switch 13 may be used to input a command to start or stop operations of the sewing machine 1, that is, a command to start or stop sewing.

Figure 3:
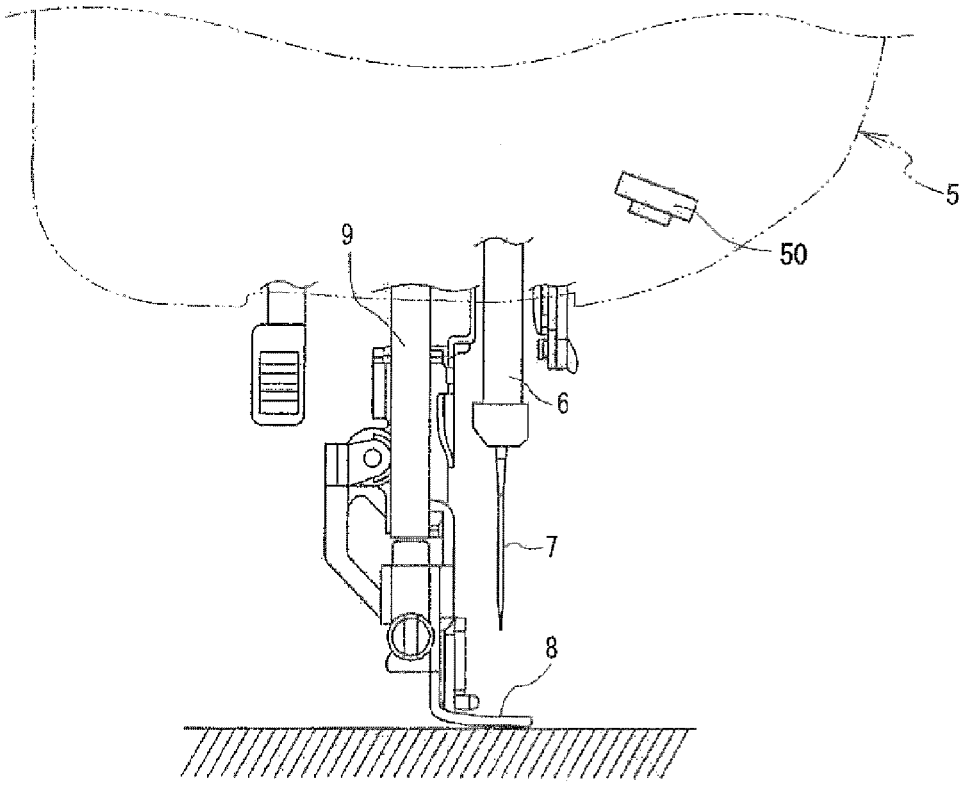
FIG. 3 is an explanatory figure that shows a structure of a lower end portion of a head and the interior of the head.

As shown in FIGS. 1 and 3, a needle bar 6 is provided in the lower portion of the head 5. The sewing needle 7 may be attached to or detached from the lower end of the needle bar 6. A presser foot 8 that is configured to press the sewing workpiece from above may be fixed to the lower end of a presser bar 9 that is provided at the rear of the needle bar 6. The presser foot 8 may be moved up and down along with the presser bar 9. As shown in FIG. 3, an image sensor 50 is provided within the head 5. The image sensor 50 may be a well-known Complementary Metal Oxide Semiconductor (CMOS) image sensor, for example. The image sensor 50 is configured to capture an image of a predetermined range on the bed 2 and output image data. The output image data may be stored in a specified area in a RAM 63.

Other than those explained above, a needle bar up-down movement mechanism 86 (refer to FIG. 5), a needle bar swinging mechanism 88 (refer to FIG. 5), and the like are provided in the head 5. The needle bar up-down movement mechanism 86 is configured to move the needle bar 6 up and down along with the rotation of the drive shaft. The needle bar swinging mechanism 88 is configured to swing the needle bar 6 in a direction (the left-right direction) that is orthogonal to a feed direction (the front-rear direction) in which the sewing workpiece is fed by the feed dog 25.

Figure 4:
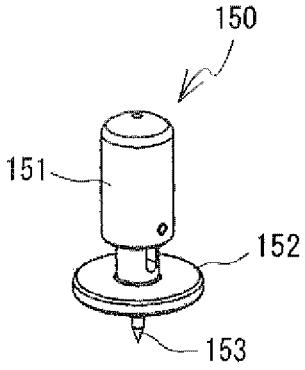
FIG. 4 is an oblique view of the pivot pin.

A circular stitching device 100 will be explained with reference to FIGS. 1, 2, and 4. The circular stitching device 100 is an implement that is configured to be mounted on the sewing machine 1 and that enables circular stitching by anchoring the sewing workpiece in a rotatable manner at an anchor position that is set apart from a needle drop point. The circular stitching refers to forming of stitches in a circular shape as the sewing workpiece is rotated about the anchor position. The circular stitching device 100 that serves as an example in the present embodiment has the same structure as a circular stitching device that is disclosed in Japanese Laid-Open Patent Publication No. 2010-178837, the relevant portion of which is incorporated herein by reference. As shown in FIG. 1, the circular stitching device 100 includes a body 120, a movable portion 130 that is movably held by the body 120, and a pivot pin 150 that can be attached to or removed from the movable portion 130.

The body 120 is a thin plate member that is substantially rectangular in a plan view and is configured to be removably mounted on the top face of the needle plate 20. As shown in FIG. 2, the body 120 includes a recessed portion 123 close to its right end that is recessed toward the rear from the front edge. A part of the body 120 that is to the right of the recessed portion 123 is called a mounting portion 121, and a part of the body 120 that is connected to the left edge of the mounting portion 121 and extends to the left is called a guide portion 122.

The mounting portion 121 is a part that is configured to be affixed to the right edge of the needle plate 20 by a screw 129. The body 120 may be affixed to the needle plate 20 in a state in which the needle hole 21 and the rectangular holes 22 are positioned on the inner side of the recessed portion 123. When the presser foot 8 (refer to FIG. 1) is moved downward and presses against the sewing workpiece, the presser foot 8 is disposed on the inner side of the recessed portion 123.

The guide portion 122 is a part that is configured to hold the movable portion 130 such that the movable portion 130 is able to move. Scale marks 124 are provided at specified intervals (for example, at five-millimeter intervals) along the front edge of the guide portion 122. The scale marks 124 may be used as guides for positioning the movable portion 130 in relation to a left needle drop point (in the present embodiment, the position of the sewing needle 7 that is shown in FIG. 2) that is the position where the sewing needle 7 pierces the sewing workpiece. A rail groove 125 that is an opening that extends in a straight line in the left-right direction is provided in the rear portion of the guide portion 122. A plurality of V-shaped notches are formed at specified intervals (for example, at five-millimeter intervals) along the front edge of the rail groove 125.

The movable portion 130 is a member that is L-shaped in a plan view. The movable portion 130 has a length in the left-right direction that is approximately one-fourth that of the guide portion 122 and has a height that is greater than the length of a pin 153 of the pivot pin 150 (refer to FIG. 4), which will be described later. An engaging portion 135 that projects downward (only the right edge of which is shown in FIG. 2)

is provided in the rear portion of the movable portion 130. The engaging portion 135 is configured to move along the rail groove 125 of the guide portion 122 and to engage with the V-shaped notches. When the engaging portion 135 is moved to one of the left and the right along the rail groove 125 and engaged with one of the V-shaped notches, the movable portion 130 is held in a position that corresponds to one of the scale marks 124. Further, a triangular marker 133 that projects toward the front is provided in a central portion of the movable portion 130 in the left-right direction. The value for the scale mark 124 that the marker 133 points indicates the radius of the circle for the circular stitching.

A pin holder 131 that is approximately rectangular in a plan view is provided in the right front portion of the movable portion 130. An indicator 140 and a through-hole 141, through which is passed the pin 153 of the pivot pin 150 (refer to FIG. 4), which will be described later, are formed in the top face of the pin holder 131. The indicator 140 includes grooves that extend radially from the through-hole 141 at the center in three directions at 120-degree intervals, thus forming a Y shape. Each of the three grooves of the indicator 140 is a shallow, straight-line groove. The indicator 140 has a function of guiding the insertion of the pin 153 of the pivot pin 150 into the through-hole 141 and a function of indicating the position of the through-hole 141 in an easily perceivable manner. In the present embodiment, the indicator 140 is an object of identification in an image during circular stitching processing, which will be described later. For that reason, in order to facilitate the identification, it is preferable for the three grooves to be colored a different color from the area around them.

Although not shown in the drawings, anchoring claws are provided below the pin holder 131 inside the movable portion 130. The anchoring claws are configured to hold the pin 153 that has been inserted into the through-hole 141 by clamping the pin 153 from the left and the right by the energizing force of a coil spring. An operating portion 132 is provided on the front side of the pin holder 131. The operating portion 132 is configured to release the hold of the anchoring claws, when the operating portion 132 is pressed toward the rear.

The pivot pin 150 will be explained with reference to FIG. 4. The pivot pin 150 includes a cylindrical holder portion 151, a cover member 152, a part of which is inserted in the lower portion of the holder portion 151, and the pin 153, the sharp tip of which projects downward from the cover member 152. The holder portion 151 holds the base end of the pin 153 in a fixed state along the central axis of the holder portion 151. The cover member 152 is configured to move up and down in relation to the holder portion 151. The lower edge of the cover member 152 is formed into a flange shape that projects radially toward the outer side of the holder portion 151. A coil spring (not shown in the drawings) that energizes the cover member 152 downward in relation to the holder portion 151 is disposed between the holder portion 151 and the cover member 152.

When the tip of the pin 153 of the pivot pin 150 is inserted into the through-hole 141 of the pin holder 131, the pivot pin 150 is held in the movable portion 130 by the anchoring claws inside the pin holder 131 (refer to FIG. 1). In the present embodiment, the pivot pin 150 is an object of identification in an image during the circular stitching processing, which will be described later. For that reason, in order to facilitate the identification, it is preferable for at least the holder portion 151 to be colored a different color from the pin holder 131.

A method for using the circular stitching device 100 will be explained with reference to FIGS. 1, 2, and 4. First, the user affixes the mounting portion 121 of the body 120 to the needle plate 20 with the screw 129, as shown in FIG. 1. Then, in a state in which the pivot pin 150 has been removed, as shown in FIG. 2, the user moves the movable portion 130 in the left-right direction along the rail groove 125, while checking the scale marks 124, to a position where the marker 133 points a value that corresponds to the radius of the circle for the circular stitching. Note that the radius of the circle for the circular stitching is the distance between the left needle drop point (in the present embodiment, the position of the sewing needle 7 that is shown in FIG. 2) and the through-hole 141 through which the pin 153 of the pivot pin 150 is to be inserted, that is, the anchor position of the sewing workpiece.

Then the user disposes the sewing workpiece on top of the bed 2, on which has been mounted the circular stitching device 100 from which the pivot pin 150 has been removed. The user causes the pin 153 of the pivot pin 150 to pierce the sewing workpiece at the position that will be the center of the circular stitching, and then causes the pin 153 to pass through the through-hole 141 of the pin holder 131. The clamping and holding of the pin 153 by the anchoring claws inside the pin holder 131 puts the sewing workpiece into a state of being anchored at the position of the through-hole 141 (in other words, the position of the pin 153, which is in the center of the pivot pin 150 in a plan view).

Because the cover member 152 of the pivot pin 150 is energized downward, the sewing workpiece is pressed by the cover member 152, but is also able to rotate around the pin 153 when the feed dog 25 operates. In this state, the circular stitching is performed when the user selects the desired stitch pattern and causes the sewing machine 1 to start a sewing operation.

Figure 5:
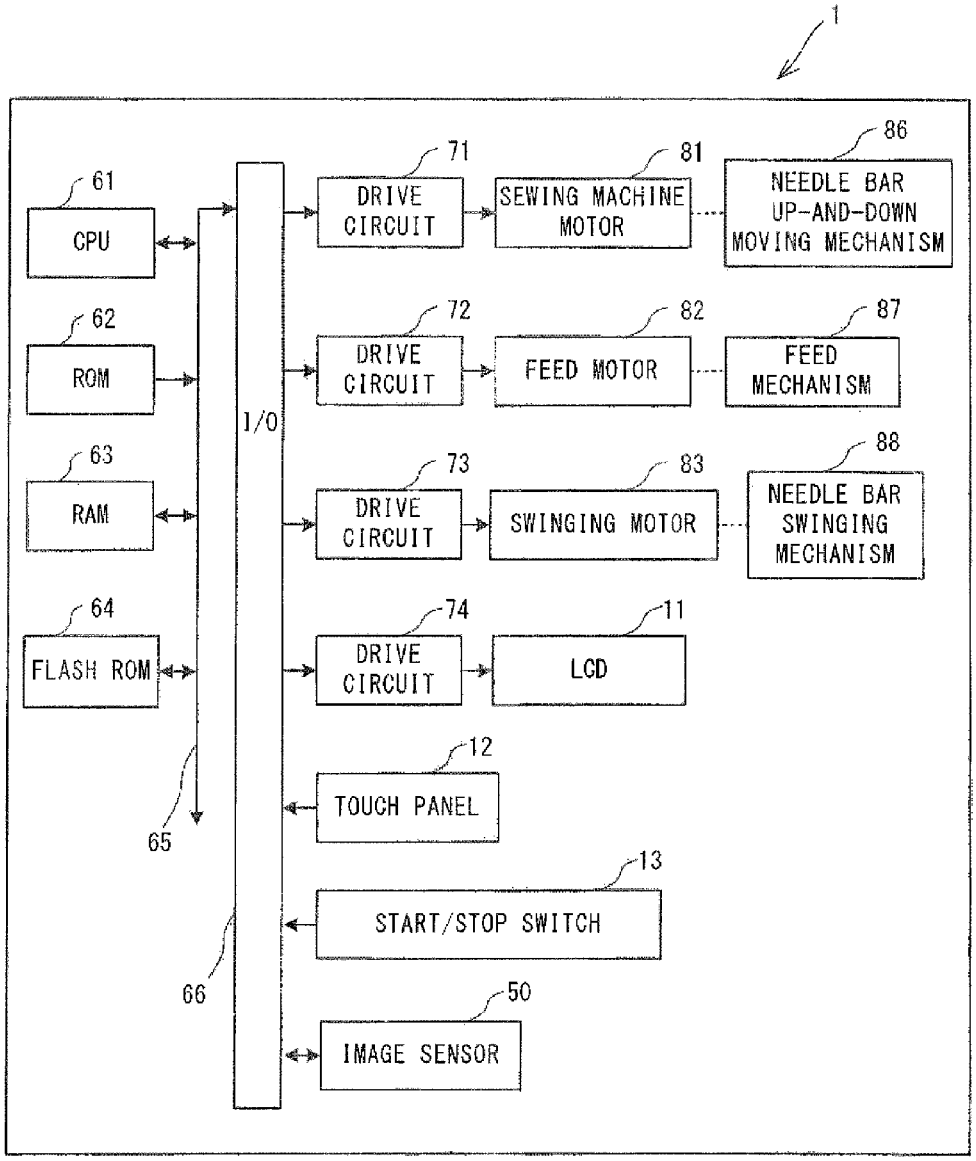
FIG. 5 is a block diagram that shows an electrical configuration of the sewing machine.

An electrical configuration of the sewing machine 1 will be explained with reference to FIG. 5. As shown in FIG. 5, the sewing machine 1 includes a CPU 61, as well as with a ROM 62, the RAM 63, a flash ROM 64, and an input/output interface (I/O) 66, each of which is connected to the CPU 61 by a bus 65.

The CPU 61 is configured to perform main control of the sewing machine 1, and in accordance with various types of programs that are stored in the ROM 62, the CPU 61 performs various types of calculations and processing that are related to sewing. The ROM 62 may include a plurality of storage areas, including a program storage area and a stitch pattern storage area, although these are not shown in the drawings. Various types of programs for operating the sewing machine 1 may be stored in the program storage area. The stored programs may include, for example, a program that causes the sewing machine 1 to perform the circular stitching processing, which will be described later. Sewing data for sewing each of the stitch patterns may be stored in the stitch pattern storage area.

In the present embodiment, the sewing data for each of the stitch patterns include at least feed amount data that indicate planned feed amounts for the feeding of the sewing workpiece by the feed dog 25. More specifically, the planned feed amounts are target values for the distances that the sewing workpiece is to be moved in the feed direction when the individual stitches of the stitch pattern are formed. In the present embodiment, data that indicate the numbers of drive pulses (including motor rotation directions) to be imparted to a feed motor 82 for feeding the sewing workpiece by the planned feed amounts are used as the feed amount data. In a case where the stitch pattern is a stitch pattern such as a zigzag stitch or the like that requires the swinging of the needle bar 6 during the sewing, the sewing data include, in addition to the feed amount data, swing amount data that indicate planned swing amounts for the swinging of the needle bar 6 by the needle bar swinging mechanism 88. For example, data that indicate the numbers of drive pulses (including motor rotation directions) to be imparted to a swinging motor 83 for fanning individual stitches may be used as the swing amount data.

In the stitch pattern storage area, for each of the stitch patterns, the length of the stitch pattern in the feed direction and (only in a case where the swing amount data are present) the width of the stitch pattern in a direction that is orthogonal to the feed direction may be stored in association with the sewing data for the stitch pattern. The length of the stitch pattern in the feed direction is equivalent to the sum of the planned feed amounts for the individual stitches in the stitch pattern.

A storage area for storing computation results and the like from computation processing that the CPU 61 has performed may be provided in the RAM 63 as necessary. Various types of parameters for the sewing machine 1 to perform various types of processing may be stored in the flash ROM 64. Drive circuits 71 to 74, the touch panel 12, the start/stop switch 13, and the image sensor 50 are connected to the I/O 66.

The sewing machine motor 81 is connected to the drive circuit 71. The drive circuit 71 is configured to drive the sewing machine motor 81 in accordance with a control signal from the CPU 61. In conjunction with the driving of the sewing machine motor 81, the needle bar up-and-down moving mechanism 86 is driven through the drive shaft (not shown in the drawings) of the sewing machine 1, and the needle bar 6 is moved up and down. The feed motor 82 is connected to the drive circuit 72. The feed motor 82 is a pulse motor that drives the feed mechanism 87. The drive circuit 72 is configured to drive the feed motor 82 in accordance with a control signal from the CPU 61. In conjunction with the driving of the feed motor 82, the feed mechanism 87 moves the feed dog 25 up and down and toward the front and the rear, thus feeding the sewing workpiece by the feed amount in accordance with the control signal.

The swinging motor 83 is connected to the drive circuit 73. The swinging motor 83 is a pulse motor that drives the needle bar swinging mechanism 88. The drive circuit 73 is configured to drive the swinging motor 83 in accordance with a control signal from the CPU 61. In conjunction with the driving of the swinging motor 83, the needle bar swinging mechanism 88 moves the needle bar 6 to the left and the right, thus swinging the needle bar 6 in accordance with the control signal. The drive circuit 74 is configured drive the LCD 11 to display an image on the LCD 11 in accordance with a control signal from the CPU 61.

Hereinafter, the circular stitching processing in the present embodiment will be explained with reference to FIGS. 6 to 10. The circular stitching processing is started when the user, by performing a panel operation, for example, inputs a command to start the circular stitching processing. The program for performing the circular stitching processing is stored in the ROM 62 (refer to FIG. 5) and is executed by the CPU 61. In the explanation that follows, an image that is described by image data that the image sensor 50 has output will be called a captured image.

Figure 6:
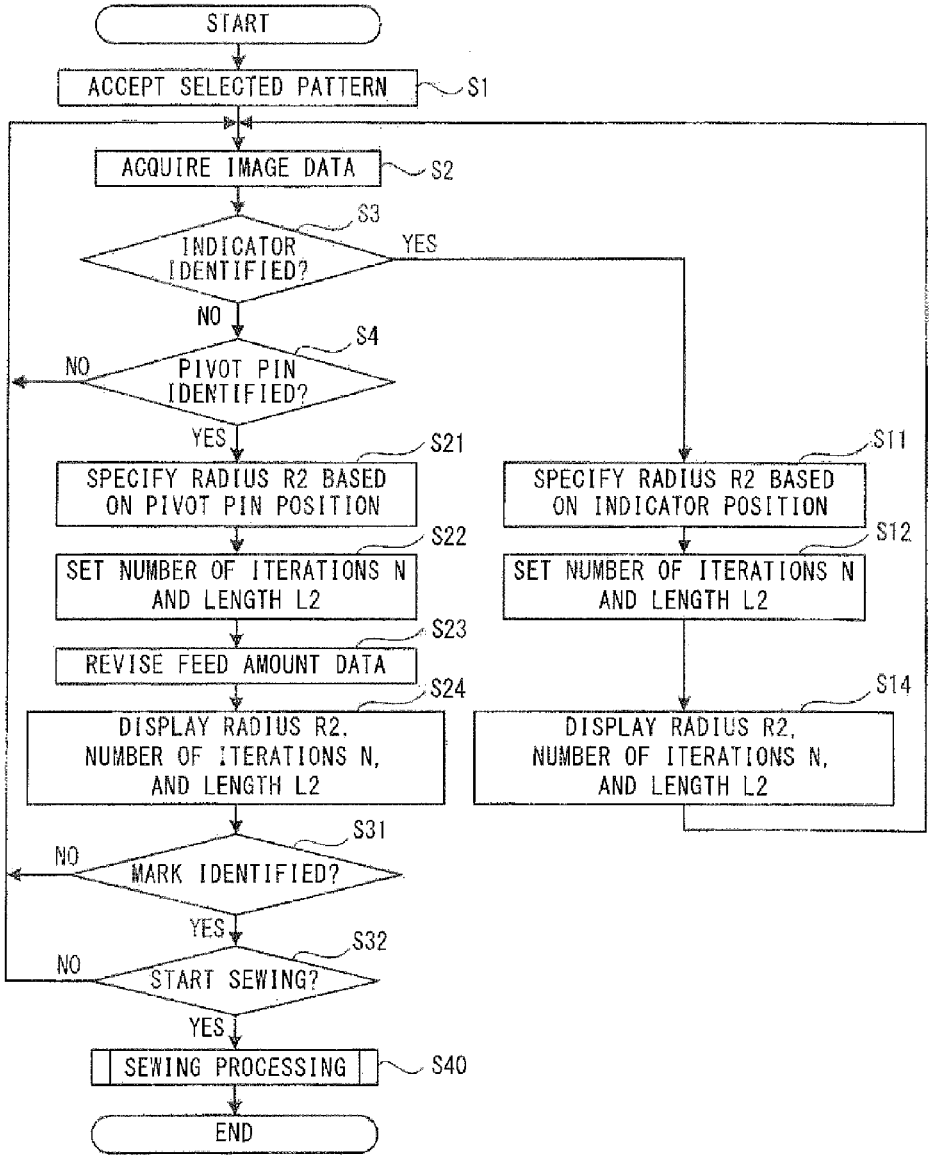
FIG. 6 is a flowchart of circular stitching processing.

As shown in FIG. 6, in the circular stitching processing, first, the CPU 61 accepts the selection of the stitch pattern to be sewn (Step S1). Specifically, for example, the CPU 61 may display on the LCD 11 a screen that shows a plurality of the stitch patterns that can be sewn by the sewing machine 1 and for which the sewing data are stored in the ROM 62. When the user selects one of the displayed stitch patterns by performing a panel operation, the CPU 61 specifies the stitch pattern that has been selected (hereinafter called the selected stitch pattern) as the stitch pattern that will actually be sewn. The CPU 61 reads the sewing data for the selected stitch pattern from the ROM 62 and stores the sewing data in the RAM 63.

By performing a panel operation on a numerical value change key that is displayed on the screen, the user can change a length L1 of the selected stitch pattern in the feed direction and a width W1 of the selected stitch pattern in a direction that is orthogonal to the feed direction. In that case, the CPU 61 revises the sewing data for the selected stitch pattern that are stored in the RAM 63 according to the changes to the length L1 and the width W1. The length L1 and the width W1 may be stored in the ROM 62 in association with the sewing data, as described previously, or the length L1 and the width W1 may be computed based on the feed amount data and the swing amount data that are included in the sewing data. If both the length L1 and the width W1 are left unchanged by the user at Step S1, the CPU 61 proceeds to the processing at Step S2 with the sewing data in the state in which the sewing data were read from the ROM 62.

Figure 8:
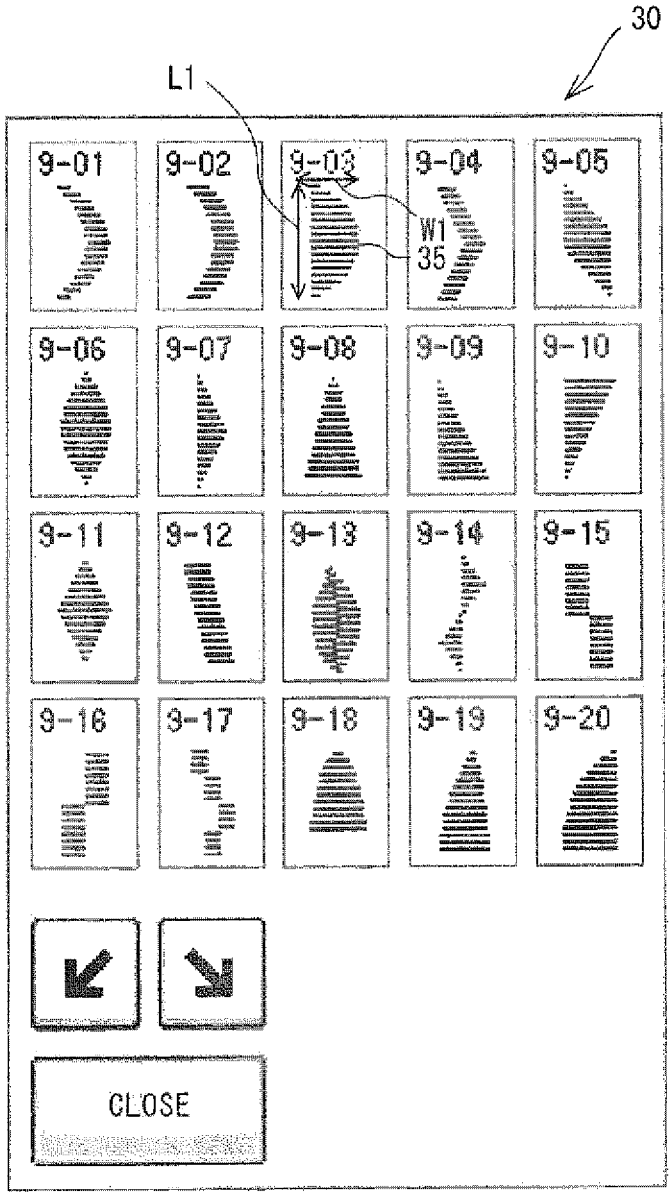
FIG. 8 is an explanatory figure of a screen for selecting a stitch pattern.

For example, at Step S1, the user may select a stitch pattern 35 from among a plurality of the stitch patterns that are displayed on a screen 30 that is shown in FIG. 8. The stitch pattern 35 is a zigzag stitch pattern that is sewn such that the positions of a plurality of right needle drop points change in small increments so as to form an arc, while the position of the left needle drop point does not change. When the stitch pattern 35 is selected, the sewing data for the stitch pattern 35 are read. The length L1 in the feed direction of the stitch pattern 35 is 20 millimeters, and the width W1 in the direction that is orthogonal to the feed direction is a maximum of 7 millimeters.

Figure 9:
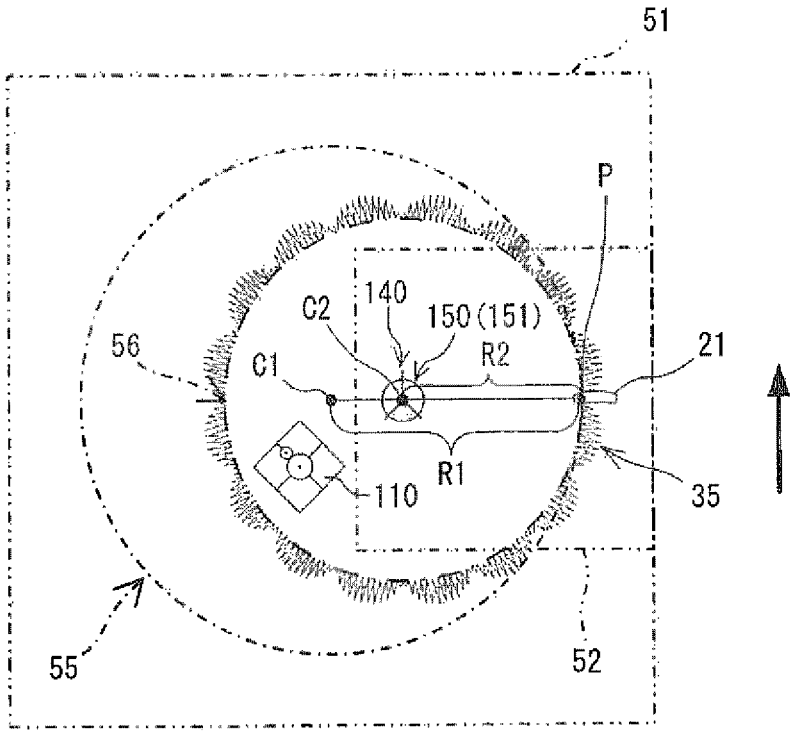
FIG. 9 is an explanatory figure of an image capture range of an image sensor.

Next, an image capture range 51 of the image sensor 50 in the present embodiment will be explained with reference to FIG. 9. As shown in FIG. 9, the image capture range 51 in the present embodiment is set to be a rectangular range that includes the needle hole 21 and encompasses a circle 55. The circle 55 is a circle with a radius R1 and a center C1. The center C1 is a point that is located to the left of a left needle drop point P at a distance that is equal to a value R1 that is the maximum value among the scale marks 124 on the circular stitching device 100.

As shown in FIG. 6, the CPU 61 causes the image sensor 50 to capture an image and acquires the most recent image data that has been output from the image sensor 50, and stores the acquired image data in a storage area of the RAM 63 that is provided for computation (Step S2). The CPU 61 determines whether or not the indicator 140 is identified within the captured image (Step S3). Any known image recognition method may be used for identifying the indicator 140. For example, lines in the captured image may be detected by edge detection. Then pattern matching may be performed that compares the detected lines to a template that is stored in the flash ROM 64 in advance and that describes the shape of the three grooves of the indicator 140. If a portion of the image contains lines in almost the same shape as in the template, that portion can be identified as the indicator 140.

In a case where the circular stitching device 100 has not been mounted on the sewing machine 1, the CPU 61 does not identify the indicator 140 (NO at Step S3). In that case, the CPU 61 determines whether or not the pivot pin 150 is identified in the captured image (Step S4). As with the indicator 140, any known image recognition method may be used for identifying the pivot pin 150. For example, edge detection may be performed, followed by pattern matching that uses a template of the circular outline of the holder portion 151. In a case where the circular stitching device 100 has not been mounted on the sewing machine 1, the CPU 61 does not identify the pivot pin 150, either (NO at Step S4). In that case, the CPU 61 returns to the processing at Step S2 and acquires the most recent image data. The CPU 61 repeats the processing that acquires the most recent image data until one of the indicator 140 and the pivot pin 150 is identified.

In a case where the user has mounted the circular stitching device 100 on the sewing machine 1 and has set the desired radius by moving the movable portion 130, the CPU 61 identifies the indicator 140 (YES at Step S3). The point where the three grooves of the indicator 140 intersect corresponds to the through-hole 141, that is, the anchor position where the sewing workpiece is to be anchored by the pin 153 of the pivot pin 150. As shown in FIG. 9, the circular stitching is to be performed with the anchor position serving as a center of rotation C2 of the sewing workpiece. Accordingly, based on the distance between the left needle drop point P and the point (the through-hole 141) where the three grooves of the indicator 140 intersect in the captured image, the CPU 61 is able to specify a radius R2 of the circle that will be formed when the circular stitching is performed (Step S11). Data that indicate the specified anchor position and data that indicate the radius R2 of the circle are stored in a specified storage area of the RAM 63.

Because the image capture range 51 is fixed, the position of the left needle drop point P in the captured image is already known. Accordingly, the position may be stored in the flash ROM 64 in advance and used. Alternatively, the left needle drop point P may be identified based on the captured image by using a known image recognition method, in the same manner as for the indicator 140, and the position of the identified left needle drop point P may be used.

Based on the length L1 of the selected stitch pattern that was accepted at Step S1 and on the radius R2 that was specified at Step S11, the CPU 61 sets a number of iterations N and a length L2 (Step S12). The number of iterations N is the number of iterations of the selected stitch pattern in a case where the selected stitch pattern is sewn repeatedly around the circumference of the circle with the radius R2. The length L2 is a length of the selected stitch pattern in the feed direction. For example, the number of iterations N and the length L2 can be computed by the method that is described in Japanese Laid-Open Patent Publication No. 4-89087, the relevant portion of which is incorporated herein by reference. Hereinafter, a specific method will be briefly explained. First, a length L of the circumference of a circle with the radius R2 is computed by the equation below. In order to simplify the values, a value of 3.1415 is used for the circumference ratio π in the equation below.

$$L=2\times3.1415\times R2$$

In a case where a value N1 that is derived by the formula below is an integer, N1 iterations of a stitch pattern with the length L1 can be disposed around the circumference of the length L without any gaps. Accordingly, in this case, N1 is set as the number of iterations N, and the length L1 is set as the length L2 (N=N1, L2=L1).

$$N1=L/L1$$

In contrast, in a case where the value N1 that is derived by the formula above is not an integer, it will not be possible to dispose a plurality of iterations of the stitch pattern around the circumference of a circle with the radius R2 without any gaps as long as the length L1 of the stitch pattern is not changed. Accordingly, the value for N1 that has been rounded off to the nearest integer is set as the number of iterations N. Next, the length L2 is computed based on the equation below. That is, the length L2 is derived that makes that the total length of N iterations of a stitch pattern with the length L2 to be equal to the length L of the circumference of the circle having the radius R2.

$$L2=L1+\{L-(N\times L1)\}/N$$

For example, in a case where the selected stitch pattern is the stitch pattern 35 that is shown in FIG. 8, the original length L1 of the stitch pattern 35 is 20 millimeters. In a case where the radius R2 for the circular stitching is 50 millimeters, for example, the length L of the circumference is 314.15 millimeters. In this case, the value N1 is 15.7, which is not an integer. Accordingly, the number of iterations N is set to 16. In this case, the total length of 16 iterations of the stitch pattern 35 is 320 millimeters, a difference of 5.85 millimeters from the length L of the circumference. Accordingly, the difference of 5.85 millimeters is distributed among the 16 iterations of the stitch pattern 35. That is, the length L2 of the stitch pattern 35 is set to 19.63 millimeters (20−5.85/16).

The CPU 61 displays on the LCD 11 an image that shows the radius R2 that was specified at Step S11 and the number of iterations N and the length L2 that were set at Step S12 (Step S14). This makes it possible for the user to confirm how many iterations of the selected stitch pattern at what length will be disposed around the circumference of the circle with the radius R2 when the selected stitch pattern is actually sewn. At Step S14, the length L1 that is the initial value of the length of the selected stitch pattern may also be displayed together with the revised length L2. In that case, the user can easily recognize the degree to which the selected stitch pattern has been lengthened or shortened from its original shape.

After displaying the number of iterations N and the length L2, the CPU 61 returns to the processing at Step S2, acquires the most recent image data, and determines whether or not the indicator 140 is identified within the captured image (Step S3). For as long as the CPU 61 identifies the indicator 140 (YES at Step S3), the CPU 61 repeats the processing at Steps S11 to S14 described above and the processing that acquires the most recent image data (Step S2). During that time, if the position of the movable portion 130 in relation to the body 120 is not changed on the circular stitching device 100, the same image continues to be displayed on the LCD 11. In contrast, in a case where at least one of the number of iterations N and the length L2 for the selected stitch pattern is different from what the user intended, the user may change the radius R2 by moving the movable portion 130 in relation to the body 120. In that case, when the most recent image data are acquired after the movable portion 130 is moved, the number of iterations N and the length L2 are set anew, based on the changed radius R2, and are then displayed.

In a case where the user intends to perform the sewing continuously after confirming the number of iterations N and the length L2 for the selected stitch pattern, the user may dispose the sewing workpiece on top of the bed 2, on which the circular stitching device 100 has been mounted. Further, by inserting the pin 153 of the pivot pin 150 into the through-hole 141 in the pin holder 131 from above the sewing workpiece, the user may anchor the sewing workpiece at that position such that the sewing workpiece can be rotated. In a state in which the indicator 140 is covered by the sewing workpiece, when the most recent image data are acquired (Step S2), the indicator 140 is not identified within the captured image (NO at Step S3). Moreover, after the sewing workpiece has been disposed on the bed 2, the pivot pin 150 is not identified (NO at Step S4) until the pin 153 of the pivot pin 150 is inserted into the through-hole 141.

When the most recent image data are acquired (Step S2) after the pin 153 of the pivot pin 150 is inserted into the through-hole 141 from above the sewing workpiece, the pivot pin 150 is included in the captured image. Accordingly, the CPU 61 identifies the pivot pin 150 (NO at Step S3; YES at Step S4). In this case, the CPU 61 specifies the radius R2 of the circle that is set based on the position of the pivot pin 150 within the captured image (Step S21).

As described previously, by being inserted into the through-hole 141 from above the sewing workpiece, the pin 153 establishes the anchor position at which the sewing workpiece is anchored. The pin 153 is fixed in place along the central axis of the cylindrical holder portion 151. As shown in FIG. 9, the circular stitching is performed using the anchor position as the center of rotation C2 of the sewing workpiece. Accordingly, the CPU 61 may specify, as the radius R2 of the circle that will be formed when the circular stitching is performed, the distance between the left needle drop point P and the center of the circular outline of the holder portion 151 of the pivot pin 150 that is identified within the captured image. Note that the position of the left needle drop point P is as was explained in connection with the processing at Step S11. Based on the length L1 of the selected stitch pattern that was accepted at Step S1 and on the radius R2 that was specified at Step S21, the CPU 61 sets the number of iterations N and the length L2 (Step S22). The processing at Step S22 is the same as the previously described processing at Step S12, so an explanation will be omitted here.

Based on the length L2 that was set for the selected stitch pattern at Step S22, the CPU 61 revises the feed amount data that are included in the sewing data for the selected stitch pattern that was read at Step S1, then stores the revised feed amount data in a specified storage area of the RAM 63 (Step S23). In the case of the previously described stitch pattern 35, the length L2 is 19.63 millimeters. The CPU 61 revises the feed amount data by uniformly reducing the lengths of (the planned feed amounts for) each one of the plurality of zigzag stitches that make up the stitch pattern 35. In a case where, at Step S22, N1 is set as the number of iterations N and the length L1 is set as the length L2, without any revisions, the feed amount data that were acquired and changed as desired at Step S1 may be defined as the revised feed amount data.

The CPU 61 displays the radius R2, the number of iterations N, and the length L2 on the LCD 11 (Step S24). The processing at Step S24 is the same as the processing at the previously described Step S14, so an explanation will be omitted here.

Next, the CPU 61 determines whether or not a mark 110 (refer to FIGS. 9 and 10) is identified in the captured image that was acquired at Step S2 (Step S31). In the present embodiment, the mark 110 is an example of a mark that is disposed on top of the sewing workpiece for detecting an actual amount of movement of the sewing workpiece.

Figure 10:
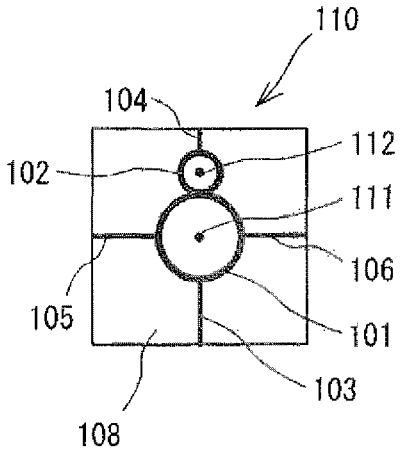
FIG. 10 is an explanatory figure of a mark.

The mark 110 will be explained with reference to FIG. 10. The mark 110 includes a white, thin plate-shaped sheet 108 and a line drawing that is drawn in black on the top face of the sheet 108. The sheet 108 may have square shape that measures 2.5 centimeters longitudinally and 2.5 centimeters laterally, for example. The line drawing that is drawn on the top face of the sheet 108 includes a first circle 101, a first center point 111 that is at the center of the first circle 101, a second circle 102, a second center point 112 that is at the center of the second circle 102, and line segments 103, 104, 105, 106.

The first circle 101 is drawn such that the center point of the square sheet 108 serves as the first center point 111. The second circle 102 is drawn in a position where it is tangent to the first circle 101 and where a virtual straight line (not shown in the drawings) that passes through the first center point 111 and the second center point 112 is parallel to one edge of the sheet 108. The diameter of the second circle 102 is less than the diameter of the first circle 101. The line segment 103 and the line segment 104 are line segments that are coincident with the virtual straight line (not shown in the drawings) that passes through the first center point 111 and the second center point 112. The line segment 103 and the line segment 104 extend from the first circle 101 and the second circle 102, respectively, to the nearest outer edge of the sheet 108. The line segment 105 and the line segment 106 are line segments that are coincident with a virtual straight line (not shown in the drawings) that passes through the first center point 111 of the first circle 101 and that is orthogonal to the line segment 103. The line segment 105 and the line segment 106 each extend from an outer edge of the first circle 101 to the nearest outer edge of the sheet 108.

The reverse face of the sheet 108 is coated with a transparent adhesive. It is therefore possible to stick the sheet 108 onto the sewing workpiece. Ordinarily, the sheet 108 is in a state in which a release paper (not shown in the drawings) is stuck to its reverse face. For example, in a case where the stitch pattern 35 will be sewn around the circumference of a circle 56 with the radius R2, as shown in FIG. 9, the user may peel the release paper off of the sheet 108 and stick the sheet 108 to the sewing workpiece inside the circle 56. Because the circle 56 is within the image capture range 51 for the image sensor 50, the mark 110 will always be within the image capture range 51, even if the sewing workpiece is rotated.

In the same manner as with the previously described identifications of the indicator 140 and the pivot pin 150, the identification of the mark 110 at Step S31 may be performed by any known image recognition method. For example, edge detection may be performed, followed by pattern matching that uses a template that shows the outlines of the first circle 101 and the second circle 102, as well as the line segments 103 to 106.

In a case where the CPU 61 does not identify the mark 110 (NO at Step S31), the CPU 61 returns to the processing at Step S2. Before returning to the processing at Step S2, the CPU 61 may display a message screen on the LCD 11 that prompts the user to stick the mark 110 onto the sewing workpiece. In a case where the CPU 61 identifies the mark 110 (YES at Step S31), the CPU 61 determines whether or not a command to start sewing is input, specifically, whether or not the start/stop switch 13 (refer to FIG. 1) is pressed (Step S32). In a case where the command to start sewing is not input (NO at Step S32), the CPU 61 returns to the processing at Step S2. In a case where the command to start sewing is input (YES at Step S32), the CPU 61 performs sewing processing (Step S40).

The sewing processing will be explained with reference to FIG. 7. In the explanation that follows, as in the previously described example, a case will be used as an example in which 16 iterations of the stitch pattern 35, for which the length L2 has been revised to 19.63 millimeters, will be sewn around the circumference of the circle 56, for which the radius R2 is 50 millimeters, as shown in FIG. 9. The arrow to the right of the needle hole 21 indicates the direction in which the sewing workpiece is fed by the feed dog 25.

First, the CPU 61 sets a value n of a counter to 1 and stores the value n in the RAM 63 (Step S41). The value n is a variable for setting each of the 16 iterations of the stitch pattern 35 that will be sewn around the circumference of the circle 56 in order as the object of the processing.

The CPU 61 acquires the most recent image data (Step S42) and specifies the position of the mark 110 within the captured image (Step S43). Specifically, the CPU 61 identifies the mark 110 within the captured image as was explained previously for the processing at Step S31. For example, within the captured image, the CPU 61 specifies as the position of the mark 110 the position of the first center point 111, which is the center of the first circle 101 of the mark 110. In a specified storage area of the RAM 63, the CPU 61 stores data that indicate the specified position of the mark 110. In the present embodiment, the position of the mark 110 is used for specifying the amount of movement of the sewing workpiece. For that reason, at least the data that indicate the position of the mark 110 that are specified by the current round of processing and the data that indicate the position of the mark 110 that are specified by the preceding round of processing are stored in the RAM 63.

The CPU 61 specifies the actual amount of movement of the mark 110 (hereinafter called the actual movement amount) based on data that indicate the position of the mark 110 that was specified by the immediately preceding processing at Step S43 and the position of the mark 110 that was specified at the time that the previous round of processing at Step S43 was performed and that was stored in the RAM 63 (Step S44). In the present embodiment, the actual movement amount is the distance between the position of the first center point 111 that was specified by the immediately preceding processing at Step S43 and the position of the first center point 111 that was specified by the previous round of processing at Step S43. As will be described later, in the present embodiment, the most recent image data are acquired and the position of the mark 110 is specified every time that one stitch is formed, that is, every time that the sewing workpiece is moved one stitch's worth by the feed dog 25, based on the feed amount data. Accordingly, the actual movement amount of the mark 110 is equivalent to the actual amount of movement of the sewing workpiece when one stitch is formed.

When the processing at Step S44 is performed for the first time, the data that indicate the position of the mark 110 that was specified by the previous round of processing is not stored in the RAM 63. Accordingly, the CPU 61 sets the actual movement amount to zero. Next, by comparing the actual movement amount that was specified at Step S44 to the planned feed amount that is specified by the feed amount data for the stitch pattern 35 that were revised and stored in the RAM 63 at Step S23, the CPU 61 determines whether or not a discrepancy has occurred (Step S45). When the processing at Step S45 is performed for the first time, the actual movement amount is zero. In this case, the CPU 61 determines that a discrepancy has not occurred (NO at Step S45) and advances to the processing at Step S47.

At Step S47, the CPU 61 forms one stitch of the stitch pattern 35 by operating the sewing machine 1 based on the sewing data. Specifically, the CPU 61 rotationally drives the drive shaft (not shown in the drawings) by operating the sewing machine motor 81 (refer to FIG. 5) through the drive circuit 71. The needle bar up-and-down moving mechanism 86 (refer to FIG. 5) is driven by the rotating of the drive shaft and moves the needle bar 6, on which the sewing needle 7 is mounted, up and down. A shuttle drive mechanism (not shown in the drawings) is also driven by the operating of the sewing machine motor 81, in synchronization with the up-down movement of the needle bar 6, such that a shuttle is rotationally driven.

The CPU 61 also operates the feed motor 82 (refer to FIG. 5) and the swinging motor 83 (refer to FIG. 5) through the drive circuits 72 and 73, respectively, in accordance with the feed amount data and the swing amount data. The feed dog 25 is thus moved and the needle bar 6 is swung in synchronization with the up-down movement of the needle bar 6. Note that the revised feed amount data that were revised at Step S23 are used as the feed amount data, and the swing amount data that were acquired at Step S1 and changed as desired are used as the swing amount data. First, one stitch of the stitch pattern 35 is formed by the operation of the sewing machine 1 in this manner.

The CPU 61 determines whether or not the sewing has been completed for one iteration of the stitch pattern 35 (Step S48). In a case where the sewing of the stitch pattern 35 has not been completed (NO at Step S48), the CPU 61 returns to the processing at Step S42 in order to form the next stitch. In order to determine whether or not the sewing has been completed for one iteration of the stitch pattern 35, the CPU 61 may count the number of stitches that have been formed for each iteration of the stitch pattern 35.

As described above, the CPU 61 acquires the most recent image data (Step S42), specifies the position of the mark 110 (Step S43), and computes the actual movement amount (Step S44). Because the mark 110 has been moved in conjunction with the feeding of the sewing workpiece when the preceding stitch was fix/lied, the CPU 61 computes a non-zero value for the actual movement amount in the second and subsequent rounds of the processing. If a discrepancy between the actual movement amount and the planned feed amount has not occurred (NO at Step S45), a stitch is formed by the previously described operation of the sewing machine 1 (Step S47).

On the other hand, in a case where a discrepancy has occurred, due to puckering or the like of the sewing workpiece (YES at Step S45), the CPU 61 stores a value that indicates the discrepancy in a specified area of the RAM 63 (Step S46). In the present embodiment, in the subsequent (n+1)-th iteration of the stitch pattern 35, the CPU 61 compensates for any discrepancies that have accumulated during the sewing of the n-th iteration of the stitch pattern 35. Accordingly, at Step S46, in a case where a discrepancy has already been stored in the RAM 63, the CPU 61 adds the most recent discrepancy to the stored discrepancy. After the discrepancy has been stored, the stitch is formed (Step S47).

When all of the stitches that make up one iteration of the stitch pattern 35 have been formed, the CPU 61 determines that the sewing has been completed for one iteration of the stitch pattern 35 (YES at Step S48). The CPU 61 determines whether or not the counter value n is equal to the number of iterations N (Step S49). At the time of the processing for the first iteration of the stitch pattern 35, the value n is less than the number of iterations N (NO at Step S49). Accordingly, the feed amount data for the next iteration of the stitch pattern 35 are revised based on the cumulative discrepancy that is stored in the RAM 63 for the just-completed iteration of the stitch pattern 35 (Step S50).

At Step S50, the CPU 61 revises the feed amount data for the stitches in the next iteration of the stitch pattern 35, for example, so as to compensate for the cumulative discrepancy. For example, in a case where the cumulative discrepancy is minus 0.2 millimeters, the CPU 61 cancels out the cumulative discrepancy in the next iteration of the stitch pattern 35 by setting the feed amount to 19.83 (19.63+0.2) millimeters. In accordance with this, the data for the numbers of drive pulses that are to be imparted to the feed motor 82, which are the feed amount data, are revised. The revised feed amount data for the next iteration of the stitch pattern 35 are stored in a specified area of the RAM 63 and are used when the stitches are formed for the next iteration of the stitch pattern 35.

The CPU 61 adds 1 to the counter value n, making the next iteration of the stitch pattern 35 the object of the processing (Step S51). At this time, the CPU 61 resets to zero the cumulative discrepancy that is stored in the RAM 63 for the (n−1)-th iteration of the stitch pattern 35, for which the processing has been completed. The CPU 61 returns to the processing at Step S42, acquires the most recent image data, and performs the same processing for the next iteration of the stitch pattern 35 (Steps S42 to S48).

The sewing is performed in the same manner, with the discrepancies that occur while any one iteration of the stitch pattern 35 is being sewn being canceled out in the next iteration of the stitch pattern 35, until the 16th iteration of the stitch pattern 35 is sewn. When the sewing is completed for the 16th iteration of the stitch pattern 35 (YES at Step S48), the CPU 61 determines that the counter value n is equal to 16, the number of the iterations (YES at Step S49), and terminates the sewing processing.

As has been explained above, in a case where the sewing machine 1 in the present embodiment performs circular stitching using the circular stitching device 100, the CPU 61, based on the image data that are output from the image sensor 50, specifies the distance between the left needle drop point and the anchor position (the position of one of the through-hole 141 of the pin holder 131 and the pin 153 of the pivot pin 150) as the radius of the circle for the circular stitching. Based on the radius of the circle and the length of the stitch pattern in the feed direction, the CPU 61 revises the feed amount data for the stitch pattern such that the total length of a plurality of iterations of the stitch pattern will be equal to the length of the circumference of the circle when the plurality of iterations of the stitch pattern are disposed around the circumference of the circle. Based on the image data from before and after the moving of the sewing workpiece, which is fed by the feed dog 25 in accordance with the feed amount data, the CPU 61 computes the actual movement amount of the mark 110 that is placed on top of the sewing workpiece, that is, the actual movement amount of the sewing workpiece. The CPU 61 revises the feed amount data for the stitches of the next iteration of the stitch pattern, based on the difference between the actual movement amount of the sewing workpiece and the planned feed amount, which is indicated by the feed amount data that have been used during the feeding of the sewing workpiece.

In a case where puckering occurs during the actual sewing, due to factors such as the pressure of the presser foot, the state of the thread tension, the material of the sewing workpiece, and the like, a discrepancy occurs between the planned feed amount that is indicated by the feed amount data and the actual movement amount of the sewing workpiece. In the sewing machine 1, the circular stitching is performed with the feed amount data being revised in accordance with the discrepancy, as described above. As a result, misalignment between the first iteration of the stitch pattern and the final iteration of the stitch pattern can be inhibited.

In the embodiment that is described above, an example was explained in which the circle 55 with the radius R1 that is the maximum radius that can be set using the circular stitching device 100 fits within the image capture range 51 of the image sensor 50, as shown in FIG. 9. However, the range within which an image can be captured varies according to the type of the image sensor 50. In particular, the larger the radius R1 that is the maximum radius that can be set by the circular stitching device 100 becomes, the more difficult it becomes to ensure an image capture range that will encompass the circle 55 with the maximum radius R1. For example, in a case where the image sensor 50 has an image capture range 52 that is shown in FIG. 9, a portion of the circle 56 with the radius R2 extends beyond the image capture range 52. Therefore, even if the mark 110 is placed within the circle 56, there will be times when the mark 110 cannot be identified, because the mark 110 is not contained within the image that is captured during the sewing processing.

Hereinafter, a modified example of the sewing processing that can be used even in a case where the mark 110 may not always be identified will be explained with reference to FIG. 11. Note that the configuration of the sewing machine 1 and the content of the processing other than the sewing processing are the same as in the embodiment that is described above, so explanations of those matters will be omitted here, and the explanation will focus mainly on the content of the processing that is different during the sewing processing. In the explanation that follows, a case will be used as an example in which 16 iterations of the stitch pattern 35, for which the length in the feed direction is 19.63 millimeters, will be sewn around the circumference of the circle 56, for which the radius is 50 millimeters, the same as in the embodiment that is described above.

Figure 11:
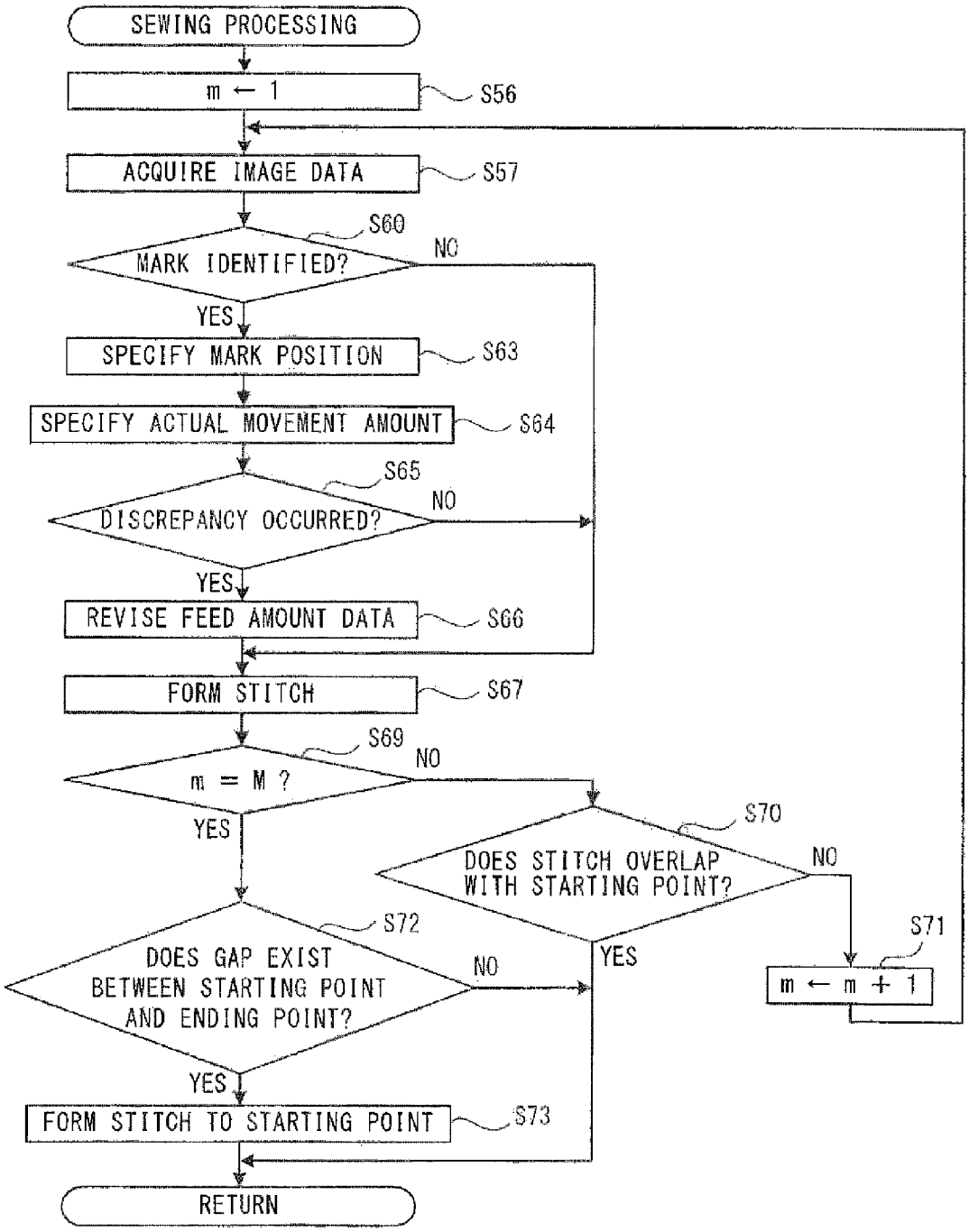
FIG. 11 is a flowchart of sewing processing according to a modified example.

As shown in FIG. 11, in the sewing processing according to the modified example, the CPU 61 first sets a value m of a counter to 1 and stores the value m in the RAM 63 (Step S56). The value m is a variable for counting the stitches of the 16 iterations of the stitch pattern 35 that will be sewn around the circumference of the circle 56. The CPU 61 acquires the most recent image data (Step S57) and determines whether or not the mark 110 is identified in the captured image (Step S60). For example, in a case where the mark 110 is positioned outside the image capture range 52, as shown in FIG. 9, the mark 110 cannot be identified (NO at Step S60). In this sort of case, the actual movement amount cannot be specified using the mark 110. Thus, the CPU 61 advances to the processing at Step S67, and forms one stitch by operating the sewing machine 1. The feed amount data that are used at this time are the data for the numbers of drive pulses that were revised at Step S23 to fit the length of 19.63 millimeters for the stitch pattern.

Next, the CPU 61 determines whether or not the counter value m is equal to a total number of stitches M for the 16 iterations of the stitch pattern 35 (Step S69). In a case where the m-th stitch that is the object of the processing is not the final stitch, and m is less than M (NO at Step S69), the CPU 61 determines whether or not the stitch that was formed at the immediately preceding Step S67 overlaps with the starting point of the circular stitching (Step S70). The starting point of the circular stitching is the starting point of the first stitch in the first iteration of the stitch pattern 35. In a case where the stitch does not overlap with the starting point (NO at Step S70), the CPU 61 adds 1 to the counter value m and returns to the processing at Step S57.

In a case where the sewing processing is started in the state that is shown in FIG. 9, the mark 110 will not enter the image capture range 52 as long as the sewing workpiece is not fed to a certain degree in the feed direction. Accordingly, for this interval, the processing in which the stitches are formed is repeated without the feed amount data being revised. Then when the mark 110 enters the image capture range 52 and is identified (YES at Step S60), the CPU 61 specifies the position of the mark 110 within the captured image (Step S63), computes the actual movement amount (Step S64), and determines whether or not a discrepancy has occurred between the planned feed amount and the actual movement amount (Step S65). The processing at Steps S63 to S65 is the same as the processing at Steps S43 to S45 in FIG. 7.

In a case where the CPU 61 has determined that a discrepancy has not occurred (NO at Step S65), the CPU 61 advances to the previously described processing at Step S67. On the other hand, in a case where a discrepancy has occurred (YES at Step S65), the CPU 61 revises the feed amount data (Step S66). In the modified example, the revision is made such that the compensation for the discrepancy is apportioned among all of the remaining the stitches of all of the remaining iteration or iterations of the stitch pattern 35 that are not yet formed. Specifically, the feed amount data are revised such that the compensation for the discrepancy is apportioned to each of the remaining (M−m) stitches.

The CPU 61 forms one stitch (Step S67) by operating the sewing machine 1 in accordance with the revised feed amount data. If the counter value m is less than the total number of stitches M (NO at Step S69) and the stitch does not overlap with the starting point (NO at Step S70), the CPU 61 increases the counter value m by 1 (Step S71) and returns to the processing at Step S57.

In the same manner, every time one stitch is formed, the CPU 61 acquires the most recent image data, and if the mark 110 is identified, the CPU 61 revises the feed amount data such that the compensation for the discrepancy that is computed at that time is apportioned among all of the stitches that have not yet been formed. The CPU 61 foams one stitch in accordance with the revised feed amount data. If the mark 110 is not identified, the CPU 61 forms one stitch in accordance with the same feed amount data that were used when the preceding stitch was formed. The CPU 61 repeats the processing.

In the modified example, when a state in which the mark 110 is not identified continues to exist, the stitches continue to be formed using the unrevised feed amount data. Accordingly, during the time when the counter value m has not yet become equal to the total number of stitches M (NO at Step S69), a case may occur in which the discrepancies accumulate and the stitch that is formed at the immediately preceding Step S67 overlaps with the starting point (YES at Step S70). In that case, it is not necessary to form any more stitches. Accordingly, the CPU 61 terminates the sewing processing.

In a case where the counter value m has become equal to the total number of stitches M (YES at Step S69), the CPU 61 determines whether or not a gap exists between the starting point and the ending point of the circular stitching (Step S72). The ending point of the circular stitching is the ending point of the final stitch in the final (16th) iteration of the stitch pattern 35. For example, the CPU 61 acquires the most recent image data. The CPU 61 then identifies the stitches that have been sewn in the 16 iterations of the stitch pattern 35 in the captured image. In a case where the area that is surrounded by the stitches is not closed, the CPU 61 may determine that a gap exists between the starting point and the ending point. The CPU 61 may also determine that a gap exists in a case where the user has looked at the sewing result, has confirmed that the gap exists, and has input information through a panel operation that indicates that the gap exists.

In a case where the CPU 61 determines that a gap does not exist between the starting point and the ending point (NO at Step S72), the CPU 61 terminates the sewing processing. In a case where the CPU 61 determines that a gap does exist between the starting point and the ending point (YES at Step S72), the CPU 61 operates the sewing machine 1 such that a part of the stitch pattern 35 (a part of the plurality of zigzag stitches that make up the stitch pattern 35) is formed up to the starting point (Step S73), then terminates the sewing processing. In this case, the CPU 61 may specify the position of the starting point based on the stitches that are identified in the captured image, for example.

As has been explained above, according to the sewing processing in the modified example that is shown in FIG. 11, even in a case where the mark 110 is not constantly present within the image capture range 52, when the mark 110 does enter the image capture range 52 and is identified, the CPU 61 is able to revise the feed amount data in accordance with the discrepancy. Furthermore, because the compensation for the discrepancy is apportioned among the feed amount data for all of the stitches of the stitch pattern 35 that have not yet been formed, the amount of the compensation in the feed amount data for any one stitch can be made smaller than it would be in a case where the compensation for the discrepancy is apportioned among the feed amount data for only some of the unformed stitches. Accordingly, it is possible to form the stitch pattern repeatedly into a natural circular shape while inhibiting any misalignment between the first iteration of the stitch pattern and the final iteration of the stitch pattern and without making the revised stitches especially obvious.

In the modified example that is described above, the compensation for the discrepancy is apportioned among the feed amount data for all of the stitches of the stitch pattern 35 that have not yet been formed. But the compensation for the discrepancy may also be apportioned among the feed amount data for only some of the unformed stitches. Specifically, among all of the stitches of all of the iterations of the stitch pattern 35 that have not yet been formed, the compensation for the discrepancy may be apportioned among the feed amount data for a specified number of stitches, the specified number being counted in the reverse order from the final stitch of the final iteration of the stitch pattern 35. In that case, prior to Step S57 in FIG. 11, for example, the CPU 61 may determine whether or not the counter value m is greater than a value B that is the difference between the total number of stitches M and a specified number that is determined in advance. In a case where the value m is not greater than the value B, it is not necessary to revise the feed amount data. Accordingly, the CPU 61 forms one stitch (Step S67) without performing the processing at Steps S57 to S66. In a case where the value m is greater than the value B, the CPU 61 revises the feed amount data for each individual stitch appropriately and forms one stitch (Steps S57 to S67). In this case as well, misalignment between the first iteration of the stitch pattern and the final iteration of the stitch pattern can be inhibited.

Various types of modifications can be made to the embodiment and the modified example that are described above. For example, the circular stitching device that is used during the circular stitching processing that is described above may be a device other than the circular stitching device 100 that has been used as an example, as long as it is a device that can be mounted on the sewing machine 1, that can anchor the sewing workpiece, such that the sewing workpiece can be rotated, at an anchor position that is set apart from the needle drop point, and that enables circular stitching to be formed as the sewing workpiece is rotated around the anchor position.

It is not always necessary for the value of the radius R2 that is set by the circular stitching device 100 to be specified using the image data that have been output from the image sensor 50. For example, after the radius R2 has been set by the circular stitching device 100, the user may use a panel operation to input the value of the radius R2. In that case, the processing at Steps S3, S11 to S14, S4, and S21 to S24 of the circular stitching processing in FIG. 6 may be omitted, and the CPU 61 may perform processing that specifies the value that has been input as the radius R2, that is, as the distance between the left needle drop point and the anchor position of the sewing workpiece.

The distance between the left needle drop point and the anchor position of the sewing workpiece (the radius R2 of the circle for the circular stitching) may also be specified based on the positional relationship among the left needle drop point, the anchor position, and the position of a marker that is provided to the movable portion 130 and is identified within the captured image instead of the indicator 140, the positional relationship among the left needle drop point, the anchor position, and the marker position being stored in advance.

It is not always necessary for information that has been set with respect to the circular stitching to be reported to the user before the sewing workpiece is placed on top of the bed 2. In other words, the processing that identifies the indicator 140 and displays the radius R2, the number of iterations N, and the length L2 (Steps S3, S11 to 14 in FIG. 6) may be omitted. Furthermore, among the information items that have been set with respect to the circular stitching, changes may be made to which of the information items are displayed. For example, at Steps S14 and S24 in FIG. 6, information items that pertain to at least one of the radius R2, the number of iterations N, and the length L2 may be displayed. The sewing machine 1 may also be provided with a speaker instead of the LCD 111, and information reporting by audio may be performed at Steps S14 and S24. It is also not always necessary for the reporting of these information items to be performed at all.

It is not always necessary for the actual movement amount of the sewing workpiece to be specified using the image data that have been output from the image sensor 50, and the actual movement amount may also be specified by a different method. For example, the sewing machine 1 may be provided with an ultrasonic sensor, and a transmitter may be mounted on the sewing workpiece. In that case, the amount of movement of the transmitter, that is, the actual movement amount of the sewing workpiece, can be specified based on the results of detection by the ultrasonic sensor.

Furthermore, in a case where the amount of movement is specified using the image data, the actual movement amount of the sewing workpiece may be specified based on the position of a characteristic point on the sewing workpiece, instead of on the position of the mark 110 in the captured image. For example, the user may use an air-soluble marker or the like to draw a mark with an easily identifiable shape (an X, for example) on the sewing workpiece in advance. In that case, in the sewing processing, the CPU 61 may acquire the image data from before and after the sewing workpiece is moved. The CPU 61 can specify the actual movement amount of the sewing workpiece by specifying the position of the intersection point of the X that was drawn on the sewing workpiece as the characteristic point in each of the captured images, instead of specifying the position of the mark 110. The CPU 61 may also specify any given characteristic point in the captured image that is based on the image data that are acquired before the sewing workpiece is moved. In that case, the CPU 61 may then compute the actual movement amount of the sewing workpiece by identifying the same characteristic point in the captured image that is based on the image data that are acquired after the sewing workpiece is moved.

The feed amount data that are revised in order to compensate for the discrepancy may be the feed amount data for at least one stitch that has not yet been formed. Accordingly, in a case other than those that are used as examples in the embodiment and the modified example that are described above, such as a case in which a plurality of iterations of the stitch pattern remain to be sewn, for example, it is acceptable to revise only the feed amount data for some of the stitches among the plurality of stitches that will form each of the remaining iterations of the stitch pattern.

Figure 7:
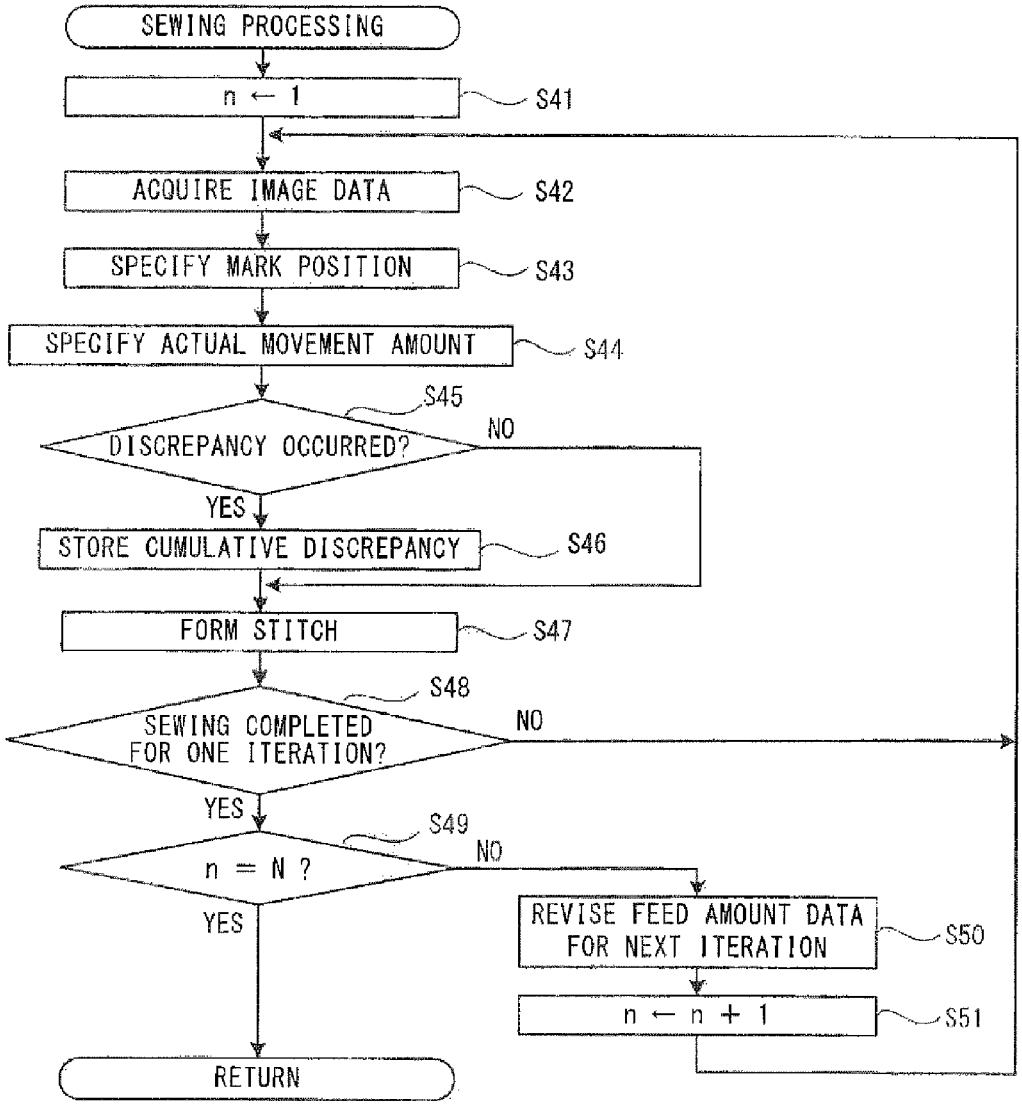
FIG. 7 is a flowchart of sewing processing that is performed by the circular stitching processing.

The sewing processing that is shown in FIG. 7 has been explained as processing that is used in a case where a circle with the maximum radius R1 that can be set using the circular stitching device 100 fits within the image capture range 51 of the image sensor 50. However, the sewing machine 1 may also switch between the sewing processing in FIG. 7 for the embodiment and the sewing processing in FIG. 11 for the modified example in accordance with the radius of the circle. For example, the CPU 61 may perform the sewing processing in FIG. 7 for the embodiment in a case where a circle with the maximum radius R1 does not fit within the image capture range, but a circle with a radius R2 that is set by the user does fit within the image capture range. The CPU 61 may perform the sewing processing in FIG. 11 for the modified example in a case where a circle with the set radius R2 does not fit within the image capture range. The switching of the processing may be done in accordance with a command that is input by the user using a panel operation, and it may also be done based on the result of a comparison of the radius R2 that is set by the processing at Step S11 in FIG. 6 with a threshold value that is stored in advance.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine to which a circular stitching device is mountable, the circular stitching device being configured to anchor a sewing workpiece in a rotatable manner at an anchor position that is set apart from a needle drop point, which is a position where a sewing needle pierces the sewing workpiece, the sewing machine comprising:

a feeding device that is configured to feed the sewing workpiece in a specified feed direction;

a sewing device that is configured to form a stitch in the sewing workpiece that is fed by the feeding device;

a processor; and a memory that is configured to store computer-readable instructions that, when executed by the processor, cause the sewing machine to execute the steps of:

specifying a distance between the anchor position and the needle drop point, changing first feed amount data into second feed amount data based on the specified distance and a length in the feed direction of a stitch pattern that includes stitches, the first feed amount data indicating a planned feed amount set in advance, the planned feed amount being a planned amount for the sewing workpiece to be fed by the feeding device in order for the stitches of the stitch pattern to be formed, the second feed amount data indicating the planned feed amount that makes a length of a circumference of a circle having a radius of the specified distance to be equal to a length in the feed direction of a plurality of iterations of the stitch pattern, specifying an actual amount of movement of the sewing workpiece that is fed by the feeding device based on the second feed amount data, and revising the second feed amount data for at least one stitch, among the stitches of the plurality of iterations of the stitch pattern, that is not yet formed, based on a difference between the specified actual amount of movement and the planned feed amount that is indicated by the second feed amount data.

2. The sewing machine according to claim 1, further comprising:

an image capture device that is configured to capture an image of a range that includes the anchor position, wherein the specifying of the distance between the anchor position and the needle drop point includes specifying the distance based on image data for the image of the range that is captured by the image capture device.

3. The sewing machine according to claim 2, wherein the specifying of the actual amount of movement includes specifying the amount of movement based on data for a first image and data for a second image, the first image being an image that is captured before the sewing workpiece is fed based on the second feed amount data, and the second image being an image that is captured after the sewing workpiece is fed based on the second feed amount data.

4. The sewing machine according to claim 3, wherein the specifying of the actual amount of movement includes specifying the amount of movement based on the position in the first image of one of a characteristic point on the sewing workpiece and a marker that is removably stuck onto the sewing workpiece and on the position of one of the characteristic point and the marker in the second image.

5. The sewing machine according to claim 1, further comprising:

an image capture device that is configured to capture an image of at least a portion of the sewing workpiece that is anchored in the rotatable manner at the anchor position, wherein the specifying of the actual amount of movement includes specifying the amount of movement based on data for a first image and data for a second image, the first image being an image that is captured before the sewing workpiece is fed based on the second feed amount data, and the second image being an image that is captured after the sewing workpiece is fed based on the second feed amount data.

6. The sewing machine according to claim 5, wherein the specifying of the actual amount of movement includes specifying the amount of movement based on the position in the first image of one of a characteristic point on the sewing workpiece and a marker that is removably stuck onto the sewing workpiece and on the position of one of the characteristic point and the marker in the second image.

7. The sewing machine according to claim 1, wherein the revising of the second feed amount data includes revising the second feed amount data for all of the stitches of one or more iterations of the stitch pattern, among the plurality of iterations of the stitch pattern, for which the stitches are not yet sewn.

8. The sewing machine according to claim 1, wherein the revising of the second feed amount data includes revising the second feed amount data for a specified number of stitches, among the stitches of the plurality of iterations of the stitch pattern, that are not yet sewn, the specified number of stitches being counted in an order that is the reverse of the order in which the stitches will be formed, starting with the final stitch of the final iteration of the stitch pattern.

9. The sewing machine according to claim 1, further comprising:

a reporting device that is configured to report at least one of information that pertains to the specified distance and information that pertains to the stitch pattern and is based on the second feed amount data.

* * * * *